US006642660B1

(12) United States Patent
Shieh

(10) Patent No.: US 6,642,660 B1
(45) Date of Patent: Nov. 4, 2003

(54) FILAMENT SHUNT MEMBER FOR DECORATIVE LAMP

(76) Inventor: Whiter Shieh, 6F, No. 245, Tun Hua South Road, Sec. 1, Taipei 106 (TW)

( * ) Notice: Subject to any disclaimer, the term of this patent is extended or adjusted under 35 U.S.C. 154(b) by 0 days.

(21) Appl. No.: 10/193,134

(22) Filed: Jul. 12, 2002

(51) Int. Cl.[7] ..... H01J 7/44; H05B 37/03
(52) U.S. Cl. ..... 315/75; 315/185 S
(58) Field of Search ..... 315/52, 122, 129, 315/185 R, 185 S, 123, 225, 184, 75, 125, 186

(56) References Cited

U.S. PATENT DOCUMENTS 3,968,398 A * 7/1976 Lehmann et al. ..... 315/185 S
4,223,248 A * 9/1980 Tong ..... 315/185 S
4,227,228 A * 10/1980 Cheng ..... 361/104
4,253,233 A * 3/1981 Lovrekovic et al. ..... 29/857
4,340,841 A * 7/1982 Schupp ..... 315/75
4,808,885 A * 2/1989 Bauch et al. ..... 315/122
4,991,071 A * 2/1991 Braasch ..... 362/249
5,453,664 A * 9/1995 Harris ..... 315/185 S
5,494,460 A * 2/1996 Kaiser ..... 439/509
6,323,597 B1 * 11/2001 Janning ..... 315/185 S
6,518,707 B2 * 2/2003 Gershen et al. ..... 315/129

* cited by examiner

*Primary Examiner*—Don Wong
*Assistant Examiner*—Chuc D Tran
(74) *Attorney, Agent, or Firm*—Rosenberg, Klein & Lee

(57) ABSTRACT

A shunt member includes an insulation sheath, a first lead wire having a shunt wire engaging section located in the insulation sheath, a second lead wire having a shunt wire engaging section located in the insulation sheath and adjacent to the shunt wire engaging section of the first lead wire. A shunt wire is connected between the shunt wire engaging sections of the first lead wire and the second lead wire for forming a shunt circuit of the bulb. When the shunt member is received in the lamp holder, the shunt member and the filament of the lamp are connected in parallel. An insulation bead member is further fixedly mounted between the shunt wire engaging sections of the first lead wire and the second lead wire for keeping a fixed distance therebetween.

7 Claims, 5 Drawing Sheets

FILAMENT SHUNT MEMBER FOR DECORATIVE LAMP

BACKGROUND OF THE INVENTION

1. Field of the Invention

The present invention relates generally to a shunt member for a decorative lamp unit, and more particularly to a shunt member including a first lead wire, a second lead wire, and a shunt wire wound between the first lead wire and the second lead wire.

2. Description of the Prior Art

Decorative light strings are commonly used in celebrations and festivals. The light string usually comprises a number of lamp holders connected in series to an electric wire. Bulbs, usually incandescent ones, are mounted to the lamp holders for connection with the wires. When a single lamp fails to illuminate, the whole string fails to light. It is very time-consuming to locate and replace the defective bulb. Thus, light strings with shunt circuits for overcoming the problems are known, such as U.S. Pat. Nos. 6,084,357 and 6,323,597 B1. These conventional designs of shunt circuits, however, require a shunt member to be encased in the lamp itself or are made with expensive electrical elements. The manufacturing process is also complicated.

To overcome the problems of the prior art, a filament shunt member adapted to be mounted in the lamp holder is designed in a co-pending application. The shunt member mainly includes a core made of alumina surrounded by an insulation sheath and has two ends electrically engaging a first contact and a second contact mounted in the lamp holder. When any of the lamps malfunctions, such as burning out, electrical current is capable of flowing through the shunt member to keep the other light lamps of the light string lighting. However, it is noted that a proper electric resistance of the alumina core depends on perfect surface of the alumina core. So, the shunt member should be inserted into the lamp holder very carefully. Otherwise, the surface of the alumina core is easy to be scraped, resulting in improper resistance.

Thus, it is desired to have an improved shunt member to overcome the problem.

SUMMARY OF THE INVENTION

Consequently, a primary object of the present invention is to provide a shunt member for a decorative lamp unit. The shunt member is mounted in the lamp holder of the decorative lamp unit and electrically connected with the filament of the lamp in parallel.

The other object of the present invention is to provide a shunt member comprising an insulation sheath, a pair of lead wires spaced from each other, and a shunt wire. The lead wires are extended from the insulation sheath and engage with the contacts of the lamp holder. The shunt wire is wound between the lead wires, so that the surface of the shunt wire will not be scraped by the contacts of the lamp holder.

The other object of the present invention is to provide a light string having a shunt circuit for each lamp of the light string to avoid defective lamps causing malfunction of the whole light string.

To achieve the above objects, in accordance with the present invention, there is provided a shunt member for a light bulb, which includes an insulation sheath, a first lead wire having a shunt wire engaging section located in the insulation sheath, a second lead wire having a shunt wire engaging section located in the insulation sheath and adjacent to the shunt wire engaging section of the first lead wire. A shunt wire is connected between the shunt wire engaging sections of the first lead wire and the second lead wire for forming a shunt circuit of the bulb.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
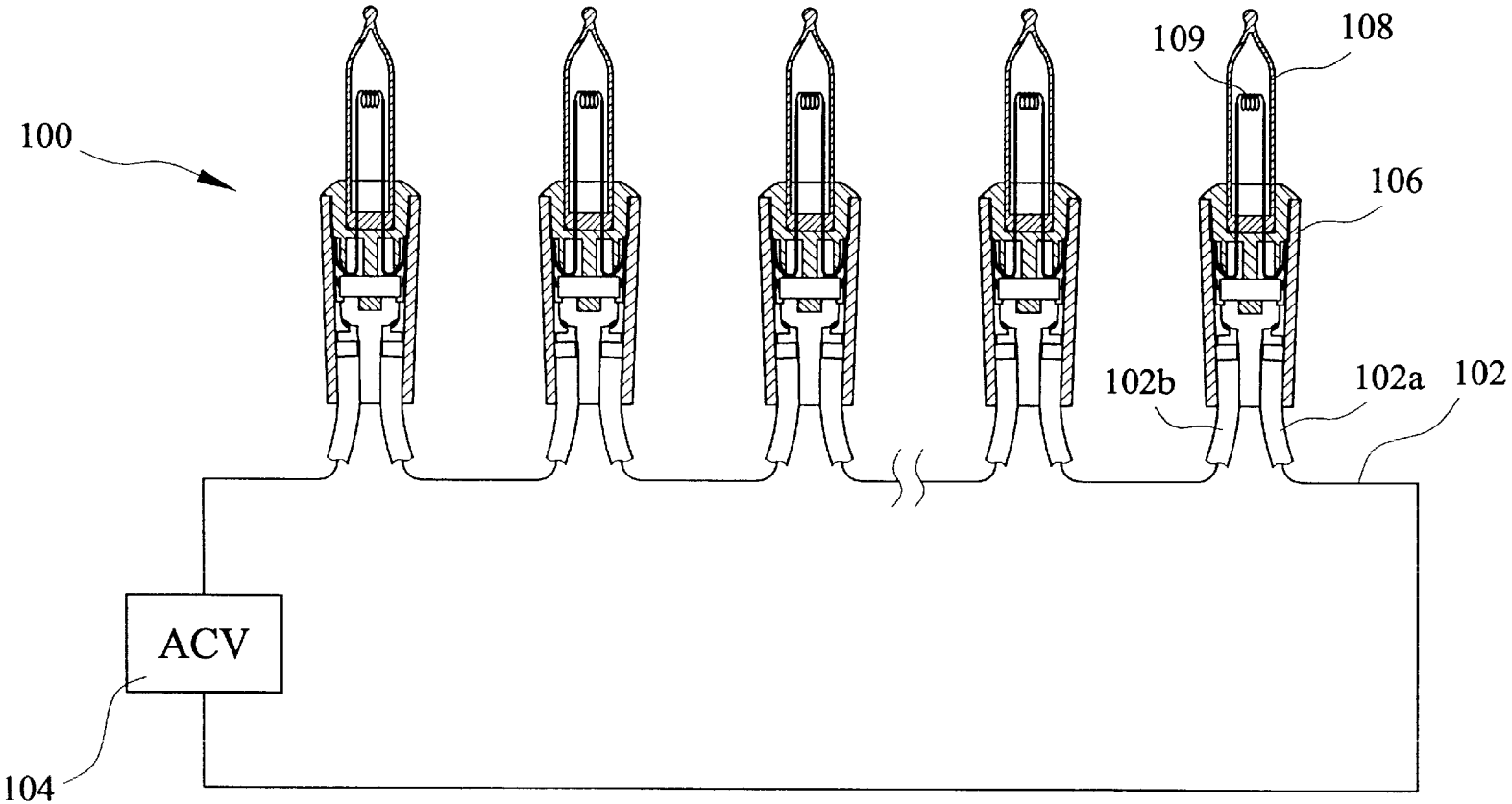
FIG. 1 is a schematic view of a light string incorporating a shunt circuit in accordance with the present invention.

With reference to the drawings and in particular to FIG. 1, a light string, generally designated with reference numeral 100, comprises electrical wires 102 connected to a power source device 104. A number of lamp holders 106 are mounted to and in electrical connection with the electrical wires 102 via a first connection wire 102*a* and a second connection wire 102*b*. Each lamp holder 106 receives and releasably retains a lamp 108 therein whereby the lamp 108 is electrically connected to the wires 102 and powered by the power source device 104 to illuminate.

Figure 2:
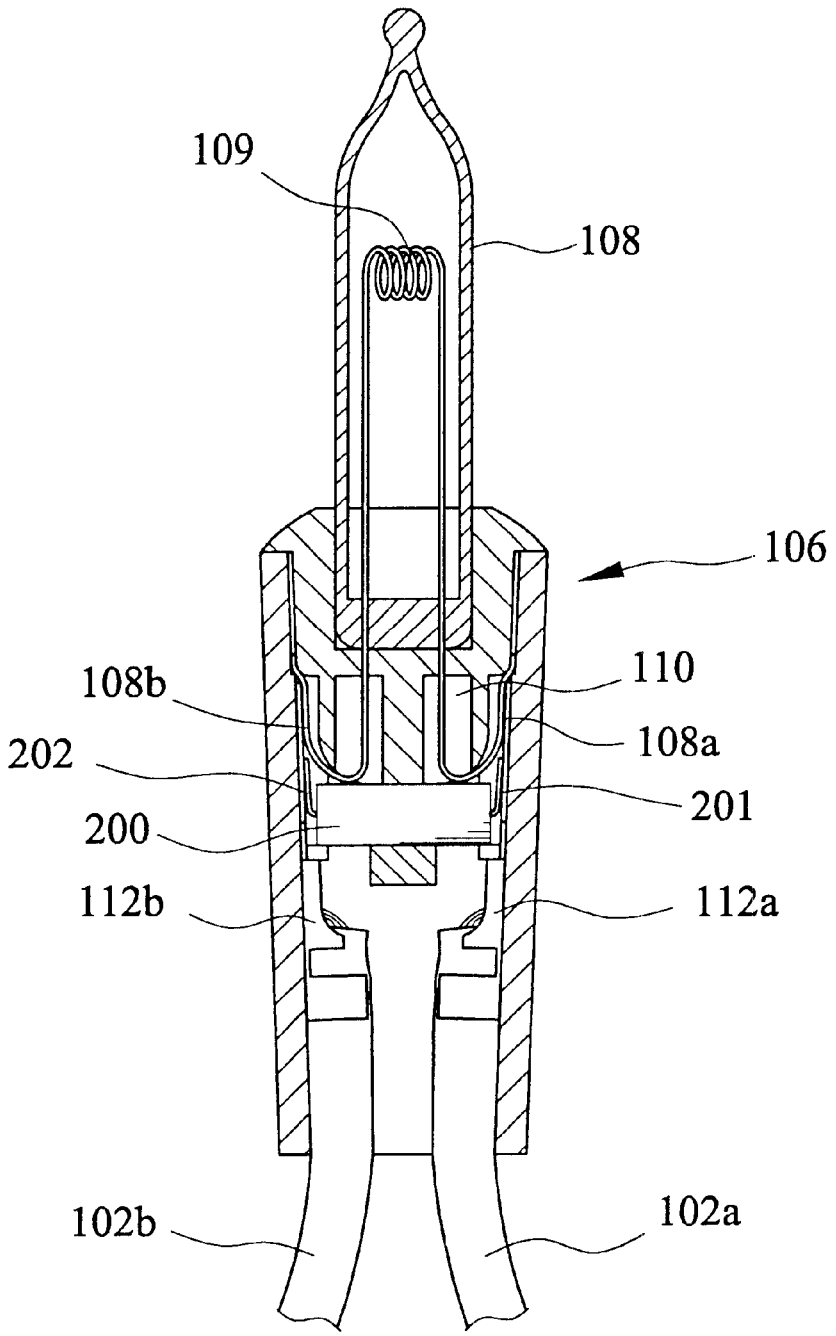
FIG. 2 is a cross-sectional view of a lamp holder of the light string with a lamp received therein.

Also referring to FIG. 2, each lamp holder 106 forms a receptacle 110 in which first and second contacts 112*a*, 112*b* that are electrically connected to the first connection wire 102*a* and the second connection wire 102*b* are fixed. The lamp 108 with a filament 109 is provided with a first lead terminal 108*a* and a second lead terminal 108*b* respectively engaging the first and second contacts 112*a*, 112*b* when the lamp 108 is mounted and received in the receptacle 110.

Figure 3:
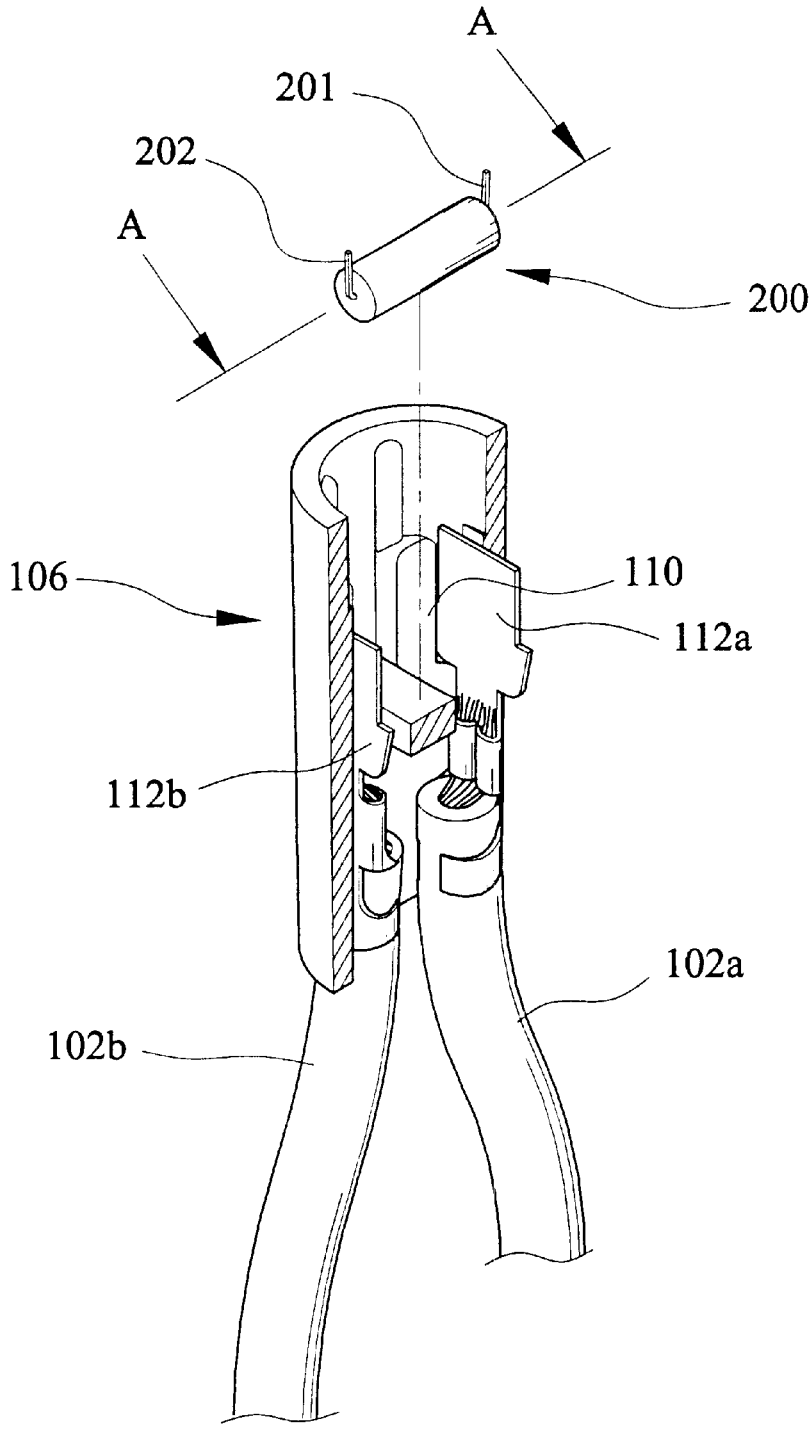
FIG. 3 is a perspective view of a lamp holder with a shunt member in accordance with a first embodiment of the present invention detached therefrom.

Also referring to FIG. 3, in accordance with a first embodiment of the present invention, a shunt member 200 is incorporated in each lamp holder 106. The shunt member 200 is received in the receptacle 110. The shunt member 200 is provided with a first lead wire 201 and a second lead wire 202. The shunt member 200 is sized to be retained inside the lamp holder 106 with the exposed lead wires 201 and 202 physically engaging the first and second contacts 112*a*, 112*b* of the lamp holder 106.

Figure 4:
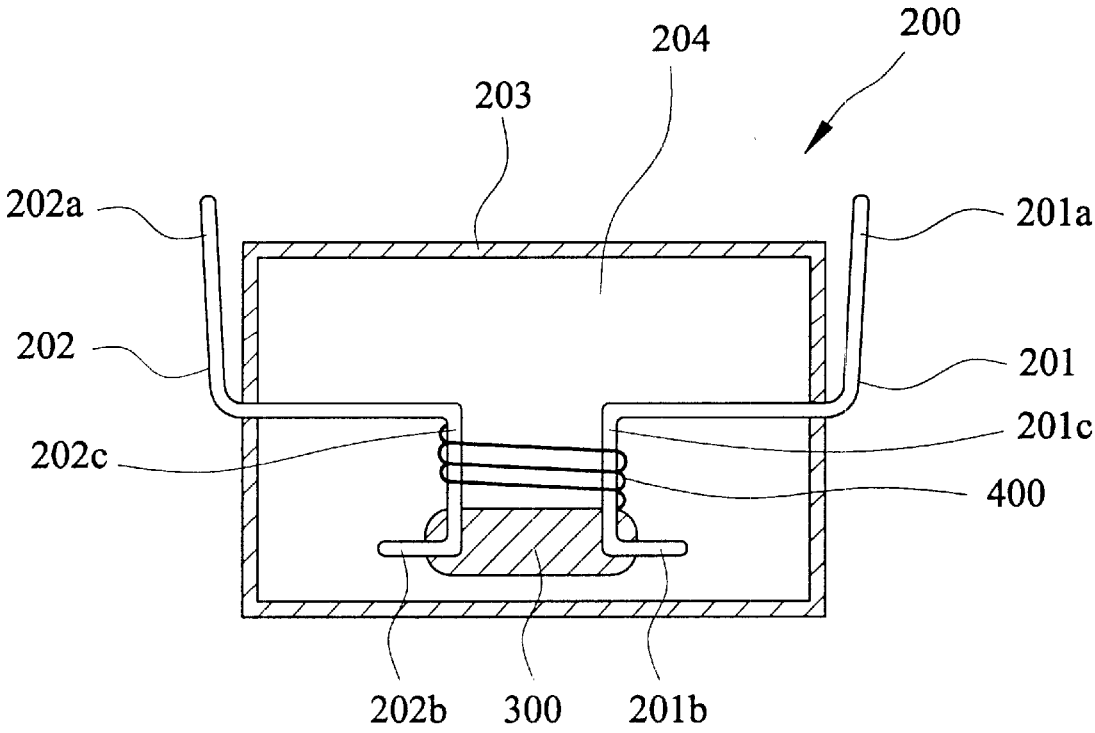
FIG. 4 is a cross-sectional view taken along line A—A of the shunt member of FIG. 3.

FIG. 4 is a cross sectional view taken along line A—A of the shunt member 200 of FIG. 3. The shunt member 200 comprises an insulation sheath 203 defining an inner space 204 therein. The insulation sheath 203 is preferably made of transparent material. The first end 201*a* of the first lead wire 201 and the first end 202*a* of the second lead wire 202 are extended from the inner space 204 to opposite ends of the insulation sheath 203 respectively, while the second end 201*b* of the first lead wire 201 and the second end 202*b* of the second lead wire 202 are bent to form a shunt wire engaging sections 201*c* and 202*c* respectively located in the inner space 204 of the insulation sheath 203. A suitable distance is retained between the shunt wire engaging sections 201*c* of the first lead wire 201 and the shunt wire engaging sections 202*c* of the second lead wire 202.

Preferably, an insulation bead member 300 is fixedly mounted between the shunt wire engaging sections 201*c* and 202*c*, so that a fixed distance is kept between the shunt wire engaging sections 201*c* and 202*c*. The insulation bead member 300 may be made of plastic material or glass.

A shunt wire 400 made of aluminum oxide or other suitable material that has electrical characteristics similar to that of aluminum oxide is wound between the shunt wire engaging sections 201*c* of the first lead wire 201 and the shunt wire engaging sections 202*c* of the second lead wire 202. The resistance of the shunt wire 400 is larger than that of the filament 109 of the lamp 108. So, the first lead wire 201 and the second lead wire 202 may be electrically conducted through the shunt wire 400. By means of winding the shunt wire 400 between the first lead wire 201 and the second lead wire 202, a proper resistance exists therebetween. In this embodiment, both of the first lead wire 201 and the second lead wire 202 are made of conductive material, such as copper wire. Thus, the shunt member 200 and the lamp 108 are connected in parallel with each other whereby when the lamp 108 malfunctions, such as burning out, electrical current from the wires 102*a* and 102*b* can flow through the shunt member 200.

Figure 5:
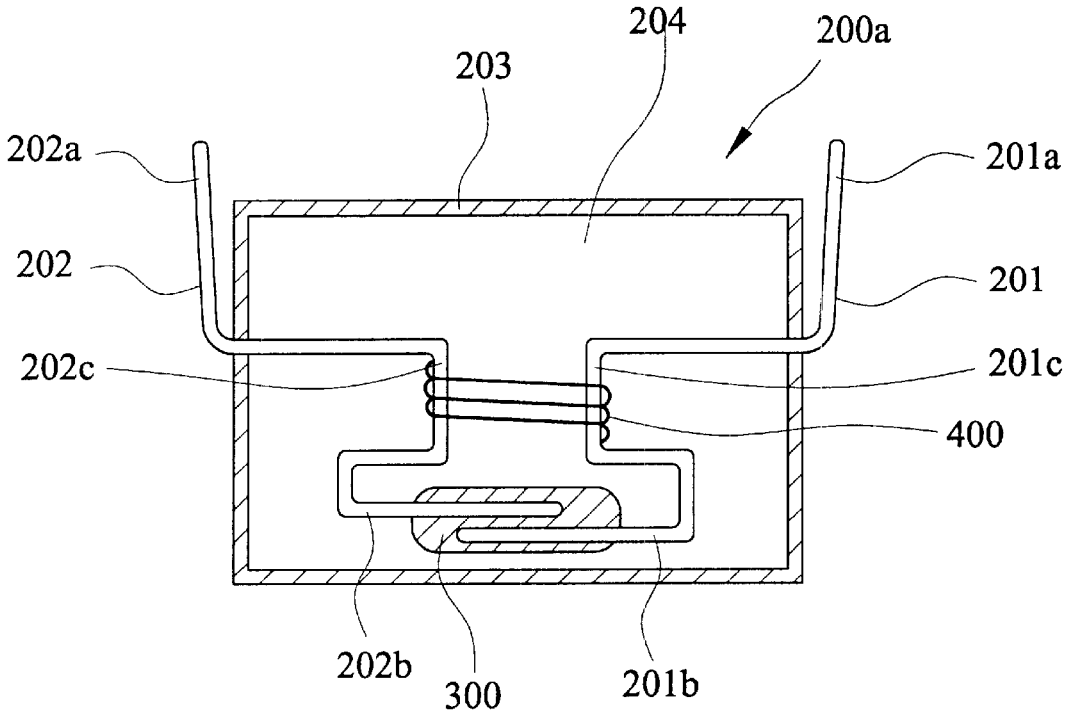
FIG. 5 is a cross-sectional view of the shunt member in accordance with a second embodiment of the present invention detached therefrom.

FIG. 5 is a cross sectional view of the shunt member, showing a shunt member constructed in accordance with a second embodiment of the present invention, generally designated with reference numeral 200*a* for distinction. The shunt member 200*a* of the second embodiment is substantially identical to that of the first embodiment whereby identical parts of the shunt member of the first and second embodiments are designated with the same reference numerals.

The only difference between the first and the second embodiments is that both the second ends 201*b*, 202*b* of the first lead wire 201 and the second lead wire 202 are further extended to a suitable distance and then bent toward each other within the inner space 204 of the insulation sheath 203. A suitable distance also exists between the second ends 201*b*, 202*b* of the first lead wire 201 and the second lead wire 202. Preferably, an insulation bead member 300 is also fixedly mounted between the second end 201*b* of the first lead wire 201 and the second end 202*b* of the second lead wire 202.

Similarly, the shunt member 200*a* may be received in the lamp holder 106 to form a shunt circuit for the lamp 108 received in the receptacle 110 of the lamp holder 106. So, the shunt member 200*a* and the lamp 108 are connected in parallel with each other whereby when the lamp 108 malfunctions, such as burning out, electrical current from the wires 102*a* and 102*b* can flow through the shunt member 200*a*.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A shunt member adapted to be removably received in a decorative lamp unit having a lamp holder defining a receptacle for receiving and retaining a lamp with a filament, a first contact and a second contact opposite to the first contact being mounted in the lamp holder, comprising:

an insulation sheath having a first end and an opposite second end;

a first lead wire extending from the insulation sheath to the first end of the insulation sheath, having a shunt wire engaging section located in the insulation sheath;

a second lead wire extending from the insulation sheath to the second end of the insulation sheath, having a shunt wire engaging section located in the insulation sheath and adjacent to the shunt wire engaging section of the first lead wire; and a shunt wire connected between the shunt wire engaging sections of the first lead wire and the second lead wire for forming a shunt circuit of the bulb;

wherein when the shunt member is received in the lamp holder, the first lead wire engages with the first contact of the lamp holder, while the second lead wire engages with the second contact of the lamp holder, so that the shunt member and the filament of the lamp are connected in parallel with each other.

2. The shunt member as claimed in claim 1, wherein the insulation sheath is made of transparent material.

3. The shunt member as claimed in claim 1, wherein both the first lead wire and the second lead wire are made of copper, while the shunt wire is made of alumina.

4. The shunt member as claimed in claim 1, wherein the shunt wire engaging sections of the first lead wire and the second lead wire are substantially parallel to each other.

5. The shunt member as claimed in claim 1, further comprising an insulation bead member fixedly mounted between the shunt wire engaging sections of the first lead wire and the second lead wire for keeping a fixed distance between the shunt wire engaging sections of the first lead wire and the second lead wire.

6. The shunt member as claimed in claim 5, wherein the insulation bead member is made of plastic material.

7. The shunt member as claimed in claim 5, wherein the insulation bead member is made of glass.

* * * * *